US005093851A

United States Patent [19]

Schäfer

[11] Patent Number: 5,093,851

[45] Date of Patent: Mar. 3, 1992

[54] DEVICE FOR PRODUCING X-RAY PICTURES

[75] Inventor: Ingo Schäfer, Hamburg, Fed. Rep. of Germany

[73] Assignee: U.S. Philips Corporation, New York, N.Y.

[21] Appl. No.: 693,973

[22] Filed: Apr. 29, 1991

[30] Foreign Application Priority Data

May 11, 1990 [DE] Fed. Rep. of Germany ..... 4015113

[51] Int. Cl.[5] ..... B41M 5/00

[52] U.S. Cl. ..... 378/29; 378/32

[58] Field of Search ..... 250/327.2 L; 378/28–32

[56] References Cited

U.S. PATENT DOCUMENTS 4,019,052 4/1977 Haas ..... 378/32
4,134,137 1/1979 Jacobs et al. ..... 358/293
4,975,935 12/1990 Hillen et al. ..... 378/28

FOREIGN PATENT DOCUMENTS 0094843 11/1983 European Pat. Off. .
0219897 11/1989 European Pat. Off. .
3534768 4/1987 Fed. Rep. of Germany .

*Primary Examiner*—Janice A. Howell
*Assistant Examiner*—Don Wong
*Attorney, Agent, or Firm*—William Squire

[57] ABSTRACT

A photoconductor for converting incident X-ray radiation into a charge pattern is on carrier constructed so as to be rotationally symmetrical with respect to an axis of rotation. A driving unit rotates the carrier and photoconductor about the axis of rotation. A charge reading unit which, after exposure to X-rays forming an X-ray picture, converts the charge pattern on the surface of the rotating photoconductor into electric picture values. Reduced picture exposure time (with the time for reading the photoconductor remaining equally low) is achieved in that the converter does not rotate during exposure to the X-rays for taking an X-ray picture.

11 Claims, 2 Drawing Sheets

DEVICE FOR PRODUCING X-RAY PICTURES

FIELD OF THE INVENTION

The invention relates to a device for producing X-ray pictures comprising an X-ray radiator for producing X-ray beams, a photoconductor for converting X-ray radiation into a charge pattern which is provided on a carrier which is constructed so as to be rotationally symmetrical with respect to an axis of rotation, a driving unit for driving the carrier about the axis of rotation, and a reading unit which, after an X-ray picture converts the charge pattern on the surface of the rotating photoconductor into electrical picture values.

BACKGROUND OF THE INVENTION

Such a device is known from DE-OS 35 34 768. The exposure of the photoconductor in this device occurs during the recording through a slot diaphragm the direction of the slot being parallel to the axis of rotation and which limits the X-ray beam to a narrow fan-shaped X-ray beam which passes through the examination area and exposes a narrow strip on the surface of the photoconductor. During the recording the carrier rotates about the axis of rotation and is moved synchronously therewith at right angles to the axis of rotation so that the examination area is projected sequentially on the surface of the photoconductor.

The reading of the charge pattern produced in this manner occurs immediately after the X-ray picture. The carrier rotates at a substantially higher speed than during the X-ray recording, and the reading device reads with one or more probes the charge on a substantially circular track on the surface of the photoconductor. In order to be able to read the whole surface, the reading unit is moved parallel to the axis of rotation at a comparatively lower average speed.

In such a device the reading can be done substantially more quickly, more precisely and more accurately than is possible with a flat photoconductor plate as it is known from the American patent U.S. Pat. No. 4,134,137. However, the fast reading is absolutely required, because the photoconductor discharges not only by the X-ray exposure but also by dark currents. On the other hand there is the disadvantage that the overall exposure time is comparatively long and that the power of the X-ray tube is used inefficiently, because only a thin radiation fan is always used for the exposure of the photoconductor.

It is to be noted that a device for producing X-ray pictures is already known from European patent application EP 94 843, in particular FIG. 8, in which a storage phosphor is provided on a cylindrical carrier which during taking the X-ray picture is stationary. Such storage phosphors lose their picture information considerably more slowly than photoconductors, so that a fast reading is not necessary. After each X-ray exposure, the carrier is rotated once about the axis of rotation in three steps, in which in the first step the X-ray picture is read with a two-dimensionally guided laser beam and in the subsequent step the storage phosphor is erased. In each step a further picture may be taken. So here the carrier stands still both during taking the X-ray picture and also during the reading process; reading cannot be done faster than in a flat record carrier.

SUMMARY OF THE INVENTION

It is the object of the present invention to provide a device which enables a fast reading of the photoconductor with short exposure times.

Starting from a device of the type mentioned in the opening paragraph this object is achieved according to the invention in that the driving unit is controlled so that the photoconductor does not rotate during taking an X-ray picture.

Whereas in the known device the carrier rotates both during taking the X-ray picture and during the reading process, this is the case only during the reading in the device according to the invention. During taking the X-ray picture the carrier with the photoconductor does not rotate and hence the area of the photoconductor destined for the X-ray picture can be simultaneously exposed in all areas, so that a short overall exposure time and a good use of the power of the X-ray tube are obtained. However, with the same maximum format of the X-ray picture (measured in the circumferential direction of the carrier and the photoconductor, respectively) the diameter of the carrier must be substantially larger than in a device of the type mentioned in the opening paragraph. Whereas in the latter only the circumference of the carrier must be larger than the picture format, the diameter of the carrier in the device according to the invention must be larger than the picture format.

In a preferred further embodiment means for the geometric picture transformation are present which compensate for the picture distortions caused by the curvature of the surface of the photoconductor. As a result of this, distortions are avoided which are inevitable due to the curvature of the rotationally symmetrical, preferably cylindrical, carrier, in case the picture format is not small compared with the drum diameter. In this picture transformation the picture elements on the drum surface are assigned to virtual picture elements in an image plane present in the X-ray beam in such a manner that the straight lines connecting corresponding picture elements and virtual picture elements intersect each other in the focus of the X-ray beam. The image plane may be tangential to the surface of the photoconductor and perpendicular to the plane defined by the focus of the X-ray radiator for producing the X-ray beam and the axis of rotation. However, another position within the X-ray beam is also possible.

In a further embodiment of the invention the driving unit of the carrier is controlled so that prior to reading an X-ray picture the carrier is swung so that an area of the photoconductor not exposed during the preceding X-ray gets in the path of the X-rays. As a result of this it is possible to produce two pictures—in the case of small picture formats even more than two—in immediate succession without intermediate reading of the photoconductor. However, condition for this embodiment is that the picture store has sufficient capacity to simultaneously store two or several X-ray pictures.

BRIEF DESCRIPTION OF THE DRAWINGS

The invention will now be described in greater detail with reference to the drawing, in which.

DESCRIPTION OF THE PREFERRED EMBODIMENT

Figure 1:
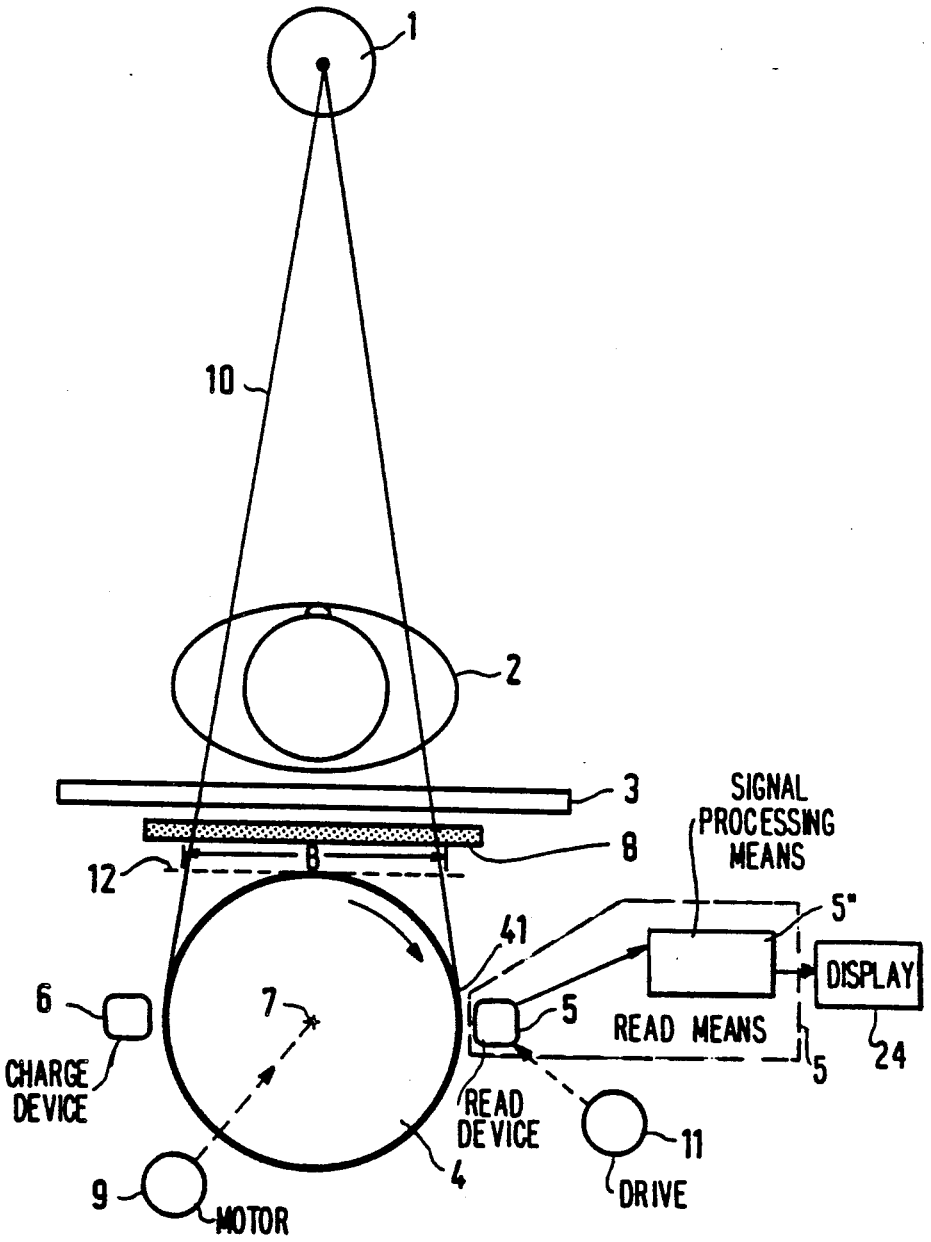
FIG. 1 shows diagrammatically an X-ray apparatus according to the invention.

In FIG. 1, the X-ray beam 10 emitted from the focus 1' of an X-ray radiator 1 passes through a patient 2 lying on a table 3 and through a stray beam raster 8 before it impinges on a cylindrical carrier (drum) 4, the cylinder axis 7 which is perpendicular to the plane of drawing of FIG. 1, is also the axis of rotation of the carrier 4. The carrier 4 may be rotated about the axis of rotation 7 by means of a driving motor 9. On its cylindrical surface the carrier 4 is coated with a photoconductor 41, preferably a 0.5 mm thick layer of selenium.

A charge device 6 which charges the rotating carrier before an X-ray-picture is taken is present outside the path of rays, so that a voltage of, for example, 1,500 volts is present between the surface of the electrically conductive carrier and the outer surface of the selenium layer. A reading means 5 includes a read device 5' which, after taking an X-ray picture, reads the charge density on one or several tracks with one or more probes Device 5' is also outside the path of the rays of beam 10. In order to be able to read the whole surface, the reading device 5' is moved relatively to the carrier 4 by means of a further driving unit 11 parallel to the axis of rotation 7 at an average speed which is small compared with the circumferential speed of the carrier. Construction and function of the reading device 5' and of the charge unit 6 are described in more detail in the German patent application DE 35 34 768.

During taking an X-ray picture the driving motor 9 for the carrier 4 is switched off so that the photoconductor 41 does not rotate. Therefore, the outside radius r of the photoconductor 41 on the carrier 4 must be sufficiently large in order that the part of the patient 2 to be recorded can be displayed entirely on the surface of the photoconductor 41. For the maximum recording format B (measured in an image plane 12 tangent to the surface of the photoconductor 41 in the vertical line—which is the line in which the plane defined by the focus 1 and the axis of rotation 7 intersects the surface of the photoconductor 41) the relation holds that $$B=2r*(1+2r/L)^{-\frac{1}{2}} \quad (1)$$

L being the distance of the focus 1' from the image plane 12.

In practice the recording format should be smaller than this limit value and should preferably be 0.95 B—or less. So for a recording format of, for example, 40 cm with a value L = 180 cm a radius r of at least 23.7 cm is required.

The geometric distortions determined by the curvature of the carrier 4 would be negligible only when the diameter (2 r) of the carrier 4 would be large compared with the dimensions of the recording format. Since this is not possible for space reasons it is necessary to compensate for the distortions. For this purpose a point in the image plane 12 is associated with each point of the part of the photoconductor layer 41 in such a manner that the straight lines connecting the associated points pass through the focus of the X-ray radiator 1. The transformation required for this purpose will be explained in more detail with reference to FIGS. 2*a* and 2*b*.

Figure 2A:
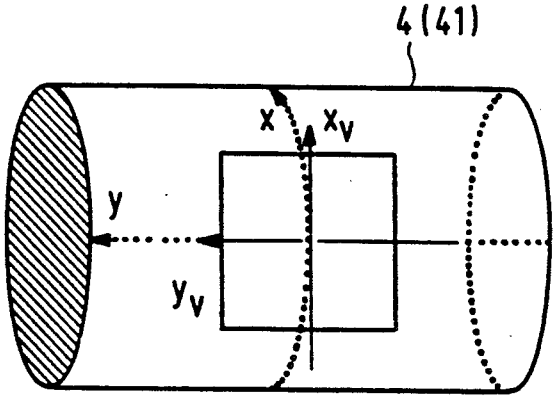
FIGS. 2*a* and 2*b* show the geometric ratios in this embodiment.
Figure 2B:
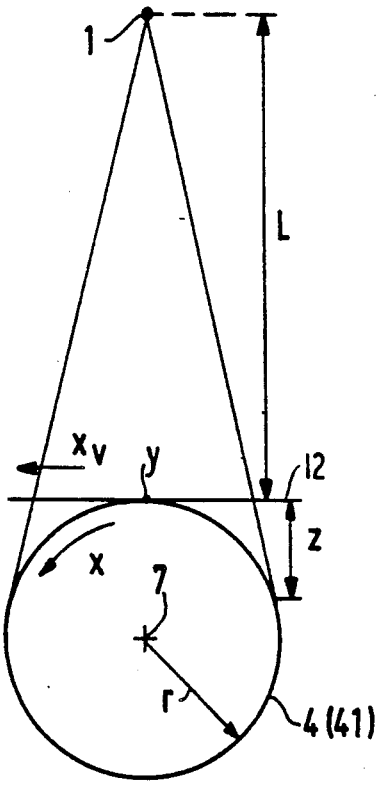

FIG. 2*a* is a perspective view of the carrier 4, while FIG. 2*b* shows the carrier in the same manner as in FIG. 1, i.e. with the axis of rotation 7 perpendicular to the plane of the drawing. The coordinates on the surface of the photoconductor 41 are referred to by x, y, where the y-axis is identical to the already mentioned vertical line in which the image plane 12 is tangent to the photoconductor. The x-coordinate of a point is the length of the arc of a circle which connects this point of the surface of the photoconductor with the y-axis. The coordinates of the associated picture point in the image plane are referred to as $x_v$ and $y_v$. The origin of the $x_v$, $y_v$ coordinate system is identical to the origin of the xy coordinate system and the $y_v$-axis coincides with the y-axis. The auxiliary quantity z denotes the distance of a picture point on photoconductor 41 from the image plane 12. For z it holds that:

$$z=r*(1-\cos(x/r)) \quad (2)$$

For $x_v$ it holds that:

$$x_v=(r^2-(r-z)^2)^{\frac{1}{2}}/(1+z/L) \quad (3)$$

Yv is computed according to the relationship:

$$Y_v=y*1/(1+z/L) \quad (4)$$

In this manner a picture point $x_v$, $y_v$ in the image plane 12 may be associated with each picture point x, y on the surface of the photoconductor hit by X-ray radiation.

It is not strictly necessary for the image plane to be tangent to the circumference of the carrier; an image in a plane parallel to plane 12 may also be computed. In this case $x_v$ and $y_v$ in the equations 3 and 4 should be weighted with a constant factor.

The image plane may also extend at an angle differing from 90° to the plane formed by the axis of rotation and the focus 1. However, the transformation equations then become more complicated. Such an inclined image plane may be formed, for example, in oblique records in which radiation passes through the patient 2 and the table 3, respectively, and in which, however, an X-ray picture is to be taken in a plane parallel to the plane of the table 3. However, it may also be useful in such an oblique picture that the image plane extends perpendicularly to the plane (which is inclined in an oblique picture) which is defined by the axis of rotation 7 and the focus 1. In this case the image plane would extend obliquely to the table 3 and the distortions occurring in conventional oblique records could be avoided.

When the picture points both in the picture produced on the photo conducting surface and also in the picture derived therefrom each have the same dimensions, for example, 0.2 mm×0.2 mm, it will result from the geometric ratios that the picture value of a picture point at the edge of the image plane 12 is composed entirely or partly from the picture values of several picture points on the surface of the photoconductor. So the weighted sum of the said picture values must be formed, the weighting factors being between 0 and 1.

As a rule the X-ray radiation within the photoconductor 41 (for example, 0.5 mm selenium) is not completely absorbed. This has for its result that an X-ray which impinges obliquely (at the edge) more strongly varies the charge density than an X-ray which is incident perpendicularly (in the center). So a homogeneous object would lead to an X-ray picture which has locally been exposed differently. This can be compensated in that the picture values I(x,y) associated with the individual picture points on the surface of the photoconductor—preferably in connection with the equalizing transformation—are multiplied by a correction factor k, so that the relation holds that $$dI_v(x_v,y_v)=k*I(x,y) \quad (5)$$

$dI_v$ being the contribution of the picture value I(x,y) to the picture value $I_v$ for the picture point $x_v$, $y_v$ in the image plane. k is the correction factor which decreases with the amount of x increasing and which takes the weighting into account. The variation of the factor k as a function of x is the more pronounced according as the X-ray radiation is harder, i.e. the higher is the voltage at the X-ray tube during the recording. With very soft radiation the dependence disappears substantially.

Figure 3:
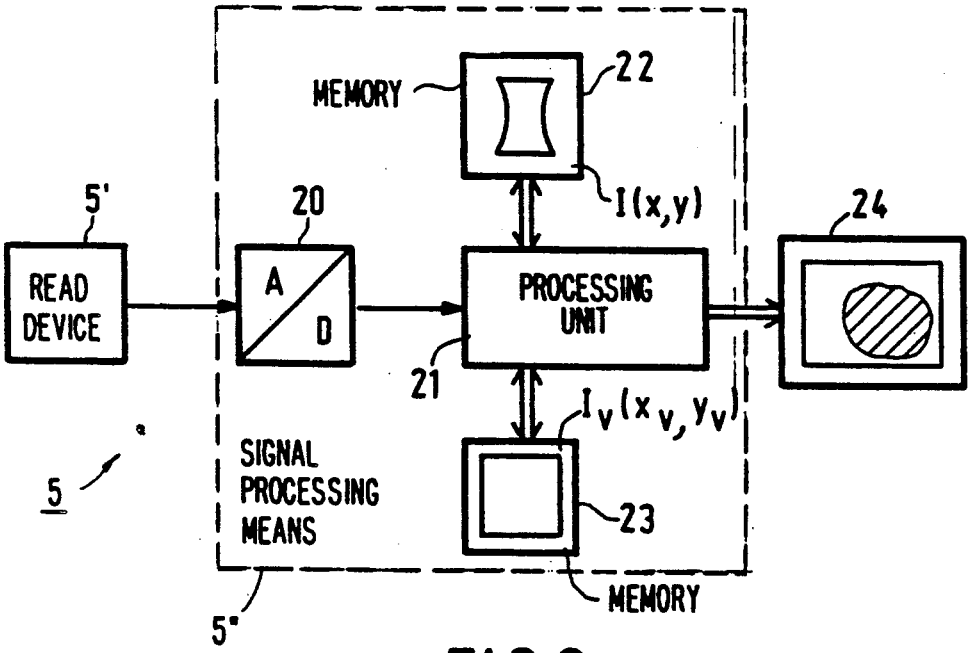
FIG. 3 shows a unit for processing the picture values provided by the reading unit.

FIG. 3 shows diagrammatically read means 5 which includes signal processing means 5'' for processing of the values provided by the reading device 5'. The values are first applied to an analog-digital converter 20 and stored in a memory 22 by a picture processing unit 21. The picture processing unit 21 calculates from the picture values memory in the store 22 according to the equations 2 to 5 the picture values $I_v(x_v, y_v)$ of the picture transformed in the picture plane and stores these in a further picture memory 23. The picture equalized and corrected in this manner may be displayed on a monitor 24.

It is not necessary that separate picture memories are present for the picture values I on the surface of the photoconductor and the picture values $I_v$ in the picture plane, as is shown in FIG. 3. When the picture values I have been used for calculation, they are no longer necessary so that the calculated picture values $I_v$ can be taken over in the memory 22. Only a buffer memory for a small part of the picture need be available.

In X-ray pictures produced by means of a photoconductor further processing steps are necessary, for example, a low-pass filtering or—as is known from the German patent application DE 38 42 525—a correction of the self-discharge of the photoconductor which takes place after an X-ray exposure. These processing steps are carried out in the picture processing unit 21 before the transformation described hereinbefore.

It is necessary in various examinations to perform two X-ray exposures in a distinct period of time which is smaller than the period required for reading a picture by the reading device 5' and means 5. Such an operation is possible by the device shown in FIG. 1 because each X-ray exposure does not even expose half of the circumference of the drum. For that purpose only the driving mechanism 9 must be controlled so that after an X-ray exposure the carrier 4 is rotated through 180°, so that in the subsequent X-ray exposure a part of the photoconductor not exposed before gets in the path of rays. With a smaller format of the X-ray picture a smaller rotation of, for example, 120° or 90° would in certain circumstances be possible, so that three or four X-ray pictures could be made in succession without intermediate reading. However, it will be obvious that in these cases the storage capacity of the picture memory 22 must be sufficient for storing two, three or four pictures.

What is claimed is:

1. A device for producing X-ray pictures comprising: an X-ray radiator for producing an X-ray beam, a carrier including a photoconductor on the carrier for converting X-ray radiation into a charge pattern, said carrier being constructed so as to be rotationally symmetrical with respect to an axis of rotation, driving means for driving the carrier about the axis of rotation, and read means which, after exposure to X-rays forms an X-ray picture, converts the charge pattern on the surface of the photoconductor into electric picture values, said driving means including means so that the photoconductor does not rotate during said exposure to said X-rays.

2. A device as claimed in claim 1 wherein the photoconductor has a curvature, said read means includes means for geometric picture transformation which compensates for picture distortions caused by the curvature of the surface of the photoconductor.

3. A device as claimed in claim 1 wherein the driving means includes means so that before reading an X-ray picture the carrier is moved so that an area of the photoconductor not exposed during the preceding X-ray picture, is moved into the path of said X-rays.

4. A device as claimed in claim 1 wherein the reading means includes means for multiplying the picture values by a correction factor (k) which for picture values at the edge of the picture is larger than in the center of the picture.

5. A device as claimed in claim 1 wherein said read means includes a read device, a further driving means being included for moving the read device in a plane lying in a line parallel to the axis of rotation and along the surface of the photoconductor.

6. A device as claimed in claim 2 wherein the driving means includes means so that before reading an X-ray picture the carrier is moved so that an area of the photoconductor not exposed during the preceding X-ray picture, is moved into the path of said X-rays.

7. A device as claimed in claim 2 wherein the reading means includes means for multiplying the picture values by a correction factor (k) which for picture values at the edge of the picture is larger than in the center of the picture.

8. A device as claimed in claim 3 wherein the reading means includes means for multiplying the picture values by a correction factor (k) which for picture values at the edge of the picture is larger than in the center of the picture.

9. A device as claimed in claim 2 wherein said read means includes a read device, a further driving means being included for moving the read device in a plane lying in a line parallel to the axis of rotation and along the surface of the photoconductor.

10. A device as claimed in claim 3 wherein said read means includes a read device, a further driving means being included for moving the read device in a plane lying in a line parallel to the axis of rotation and along the surface of the photoconductor.

11. A device as claimed in claim 4 wherein said read means includes a read device, a further driving means being included for moving the read device in a plane lying in a line parallel to the axis of rotation and along the surface of the photoconductor.

* * * * *